United States Patent [19]

Murray et al.

[11] Patent Number: 4,854,474

[45] Date of Patent: Aug. 8, 1989

[54] COMPOSITE DRINKING CUP

[75] Inventors: Lowell C. Murray; Frederick Wyss, both of Fort Wayne, Ind.

[73] Assignee: Container Corporation of America, Clayton, Mo.

[21] Appl. No.: 247,686

[22] Filed: Sep. 22, 1988

[51] Int. Cl.[4] ..... B65D 25/16; B65D 5/46

[52] U.S. Cl. ..... 220/462; 229/1.5 B; 229/23 R; 229/48 T; 229/52 B; 229/162

[58] Field of Search ..... 229/1.5 B, 162, 485 A, 229/48 T, 52 B, 23 R; 220/461, 462

[56] References Cited

U.S. PATENT DOCUMENTS

| | | | |
|---|---|---|---|
| 2,936,068 | 5/1960 | Munkachy | 229/52 B |
| 3,197,112 | 7/1965 | Meyer-Jagenberg | 229/23 R |
| 3,370,777 | 2/1968 | Levi | 229/23 R |
| 3,373,917 | 3/1968 | Cox | 229/52 B |
| 3,559,867 | 2/1971 | Muskopf | 229/23 R |
| 3,744,700 | 7/1973 | Stegmann | 229/23 R |
| 4,032,060 | 6/1977 | Bergstein | 220/462 |
| 4,284,205 | 8/1981 | Hirata | 220/461 |
| 4,391,366 | 7/1983 | Hirata | 229/52 B |
| 4,428,500 | 1/1984 | Kohler | 229/1.5 B |

*Primary Examiner*—Gary Elkins
*Attorney, Agent, or Firm*—Richard W. Carpenter

[57] ABSTRACT

A collapsible, self-standing, liquid-tight, partially transparent, disposable, drinking cup that has a tubular outer structure, formed of foldably interconnected paperboard panels, and a plastic film liner secured to the inner surfaces of certain of the panels to provide a flexible bottom wall for closing the lower end of the tubular outer structure.

15 Claims, 2 Drawing Sheets

COMPOSITE DRINKING CUP

BACKGROUND OF THE INVENTION

1. Field of the Invention

This invention relates to drinking cups and more particularly to a collapsible, self-standing, disposable drinking cup formed from a composite blank of plastic film and paperboard.

2. Description of the Background Art

A background art search directed to the subject matter of this application and conducted in the U.S. Patent and Trademark Office disclosed the following U.S. Pat. Nos. 3,003,678, 3,373,917, 3,684,157, 4,284,205, 4,391,366, 4,428,500.

None of the patents uncovered in the search discloses a collapsible, self-standing, liquid tight, partially transparent, disposable, drinking cup with an tubular outer structure formed of foldably interconnected paperboard panels and a plastic film liner secured to the inner surfaces of certain of the panels to provide a flexible bottom wall for closing the lower end of the tubular outer structure and making the cup liquid-tight.

SUMMARY OF THE INVENTION

It is an object of the present invention to provide a relatively inexpensive, collapsable, self-standing, partially transparent, disposable drinking cup, formed from a composite blank of plastic film and paperboard, that will hold liquid for a limited period of time.

A more specific object of the invention is the provision of a drinking cup, of the type described, that comprises a paperboard, tubular outer structure of foldably interconnected panels and a plastic film liner secured to the inner surfaces of certain of the panels to provide a flexible bottom wall for closing the lower end of the tubular outer structure.

It will be understood that, for purposes of clarity, certain elements may have been intentionally omitted from certain views, where they are believed to be illustrated to better advantage in other views.

DESCRIPTION OF THE PREFERRED EMBODIMENT

Figure 1:
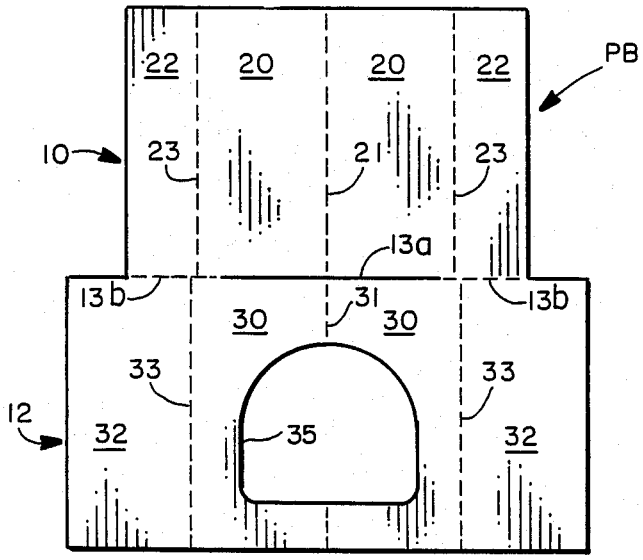
FIG. 1 is a plan view of a blank of paperboard whic his used to make the outer tubular structure of the composite cup illustrated in the other views.
Figure 2:
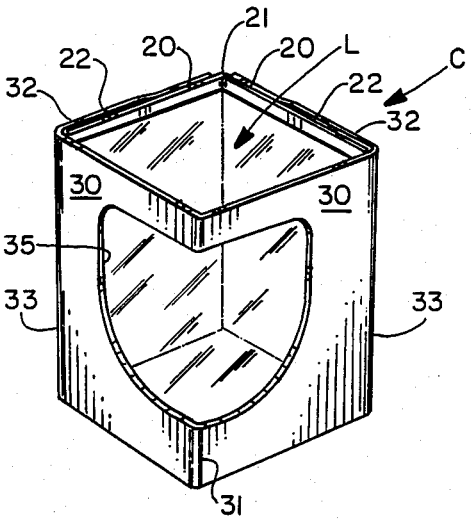
FIG. 2 is a perspective view of a composite cup embodying features of the invention, as shown in the erected position.
Figure 3:
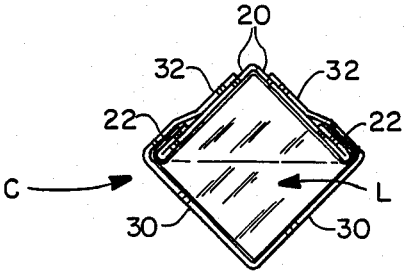
FIG. 3 is a top plan view of the structure illustrated in FIG. 2.
Figure 4:
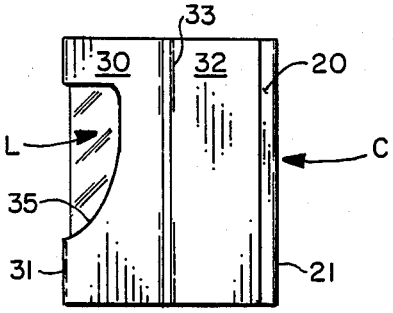
FIG. 4 is a side elevational view of the structure illustrated in FIG. 2.
Figure 5:
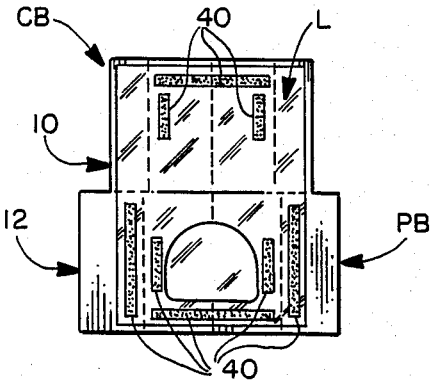
FIGS. 5, 6, and 7 are plan views of a composite blank of plastic film and paperboard used to make the cup illustrated in FIGS. 2–4, and illustrate various steps in the folding sequence whereby the cup is formed from the blank.
Figure 6:
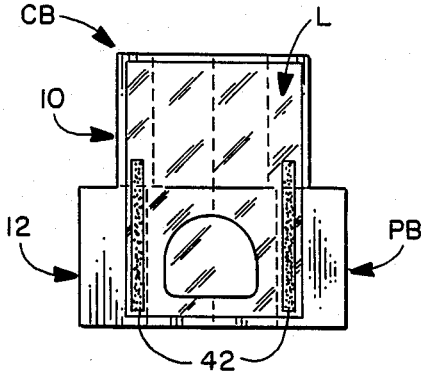
Figure 7:
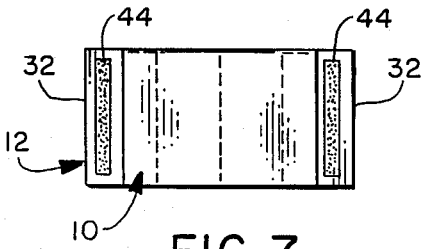
Figure 8:
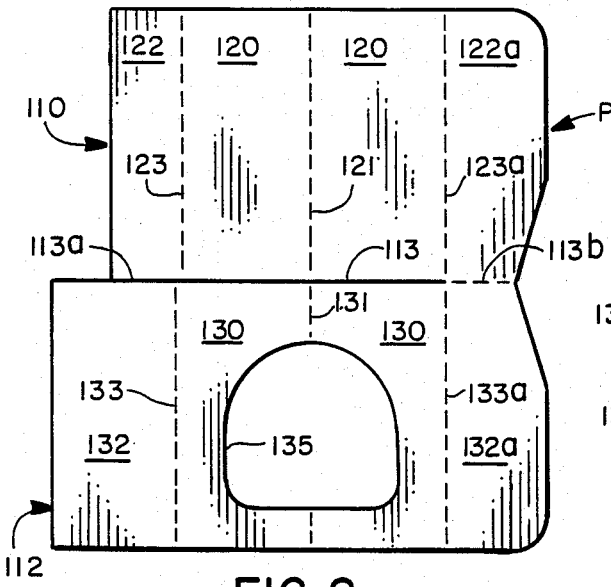
FIGS. 8–14 are views similar to those of FIGS. 1–7, but illustrate a modified form of the invention.

Referring now to the drawing for a better understanding of the invention, it will be seen that the composite cup, indicated generally at C in FIGS. 2–4, may be formed from a composite blank CB of plastic film and paperboard illustrated in FIGS. 5–7 of the drawings. The composite blank CB includes a paperboard blank, indicated generally at PB in FIG. 1, to which has been attached a liner L of a heat resistant plastic film which is preferably a polyester such as polyethylene terephthalate (PET).

As best seen in FIG. 1, the paperboard blank PB, from which the tubular outer structure of the cup is formed, includes a pair of first and second side wall members 10 and 12, respectively, which are detachably joined to each other along a transversely extending weakened line of tear 13. The line of tear 13 includes a central portion 13a, which is really a cut extending completely through the paperboard, and a pair of end portions 13b, which are cut scores or nicks that allow the two sections of the paperboard blank to be separated from each other easily when the cup is erected.

First side wall member 10 includes a pair of generally rectangular major panels 20 which are foldably joined at their inboard side edges to each other along a central fold line 21. Side wall member 10 also includes a pair of minor panels 22 which are foldably joined along fold lines 23 to the outboard edges of the respective major panels 20.

In a similar manner second side wall member 12 includes a pair of major panels 30, which are foldably joined at their inboard side edges to each other along a fold line 31, and a pair of minor 32 which are foldably joined along fold lines 33 to the outboard edges of the respective major panels 30. It will be seen that second side wall member minor panels 32 are substantially wider than related first side wall member minor panels 22. The purpose of this will be apparent later in the specification.

Still referring to FIG. 1, it will be seen that there is provided an opening 35 which extends through portions of both of the major panels 30 of second side wall member 12 and which permits viewing of the contents of the cup through the transparent liner when the cup is erected and filled.

Turning now to FIG. 5 of the drawings, it will be seen that the plastic film liner L is adhesively attached to the inner surface of the paperboard blank PB to form the composite blank indicated generally at CB.

Liner L may be applied to the inner surface of the paperboard blank PB by a conventional film glue applied in the pattern areas indicated at 40. It will be noted that the glue pattern 40 is applied to the major panels of both side wall members, but to only to the minor panels 32 of the second side wall member 12. There is no physical attachment between the liner and the minor panels 22 of first side wall member 10. This is to allow portions of the liner to shift slightly when the composite blank CB is folded and glued to form the cup C.

FIG. 6 is a view similar to FIG. 5, but illustrates the application of a pattern 42 of a hot melt adhesive to the inside surface of the liner L over the second side wall member minor panels 32 and also over adjacent portions of the first side wall member minor panels 22.

After the hot melt adhesive has been applied to the inner surface of the liner, the first side wall member 10 is folded 180 degrees to overlie the major portion of the second side wall member 12, as illustrated in FIG. 7.

At this point a third type of adhesive, a conventional folding carton glue, is applied in the pattern indicated at 44 to the surfaces of the second side wall member minor panels 32 at locations outboardly of the liner L.

Then the minor panels of both side wall members are folded 180 degrees and secured to the respective major panels of the first side wall member to form the composite cup C illustrated in FIGS. 2–4.

The cup is collapsible, but it is self-standing when in the erected condition. Because of the liner, the composite cup is liquid-tight and capable of holding hot or cold liquid for limited periods of time. The cup is intended to be a disposable cup and is not intended for reuse.

Referring now to FIGS. 8–14 of the drawings, it will be seen that a slightly modified form of the invention is shown. In this embodiment, portions of the structure corresponding to portions of the structure shown in previous views have been indicated by related numerals.

In this embodiment the two minor panels 122*a* and 132*a* are joined to each other by a fold line 113*b* which is part of weakened line 113 between side wall members 110 and 112. These two panels are adhesively secured to each other, but they are not secured to the major panel of either side wall member, as in the case of the previous embodiment. Instead, they extend laterally outward from the body of the cup to provide a handle for the cup.

Figure 15:
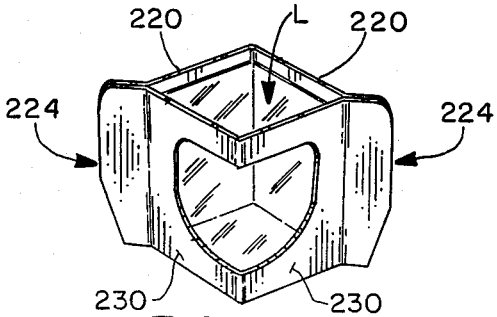
FIG. 15 is a view similar to that of FIG. 9, but illustrates yet another modified form of the invention.

Referring now to FIG. 15 of the drawings, it will be seen that yet another form of the invention is shown. Again, in this embodiment, portions of the structure which correspond to portions of the structures shown in the previously described embodiments have been designated by related numerals.

Figure 9:
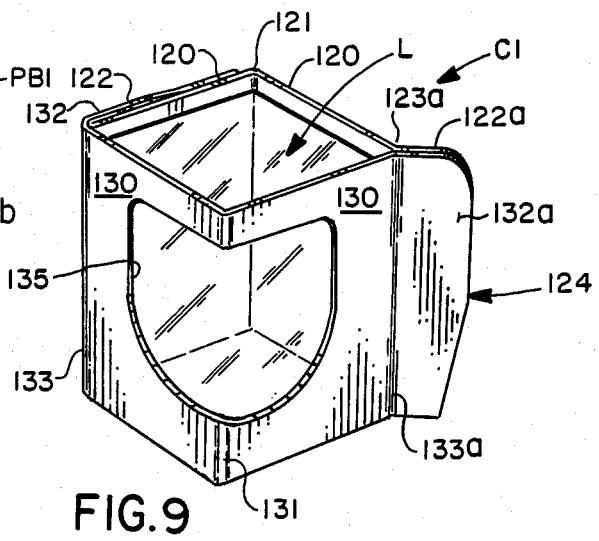
Figure 10:
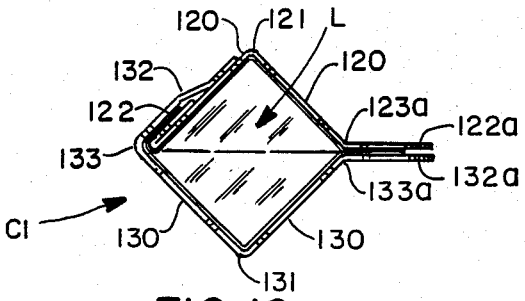
Figure 11:
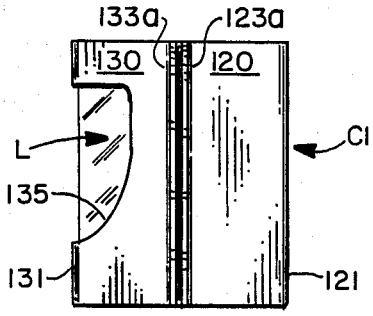
Figure 12:
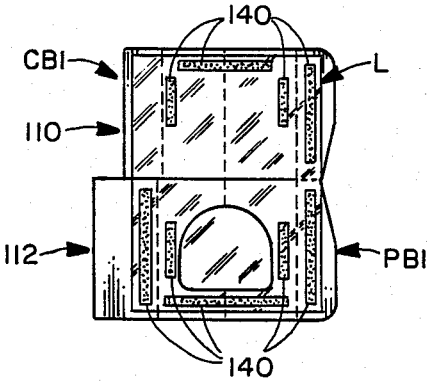
Figure 13:
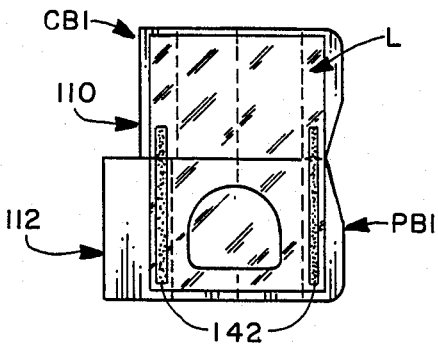
Figure 14:
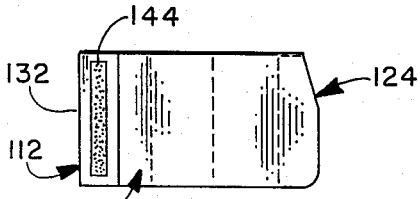

The cup of FIG. 15 is somewhat similar to that of the previously described embodiment illustrated in FIG. 9, except that a pair of handles 224 are provided. In the embodiment of FIG. 15 neither set of attached minor panels are folded around and secured to the major panels, but instead each set projects laterally outward to provide two handles for the cup.

Thus, each embodiment of the invention provides a unique and yet inexpensive composite, collapsible, self-standing, disposable, drinking cup that is sufficiently liquid-tight to hold either hot or cold liquid for a limited period.

What is claimed is:

1. A collapsible, self-standing, liquid tight, partially transparent, disposable, drinking cup formed from a composite blank of plastic film and paperboard, comprising:

(a) pair of paperboard front and rear side wall members interconnected to form a tubular structure open at its upper and lower ends;

(b) a plastic film liner adhesively secured to inner surfaces of and extending between said side wall members to form a bottom wall member for closing the lower end of said structure;

(c) said side wall members having central portions spaced from each other and having side portions joined to each other to form with said bottom wall member a liquid receiving cavity;

(d) each of said side wall members including:

(i) a pair of major panels having inboard side edges foldably joined to each other and having outboard side edges;

(ii) minor panels foldably joined to the outboard side edges of said major panels;

(e) the minor panels of said rear side wall member being reverse folded to lie against rear surfaces of adjacent major panels of said rear side wall member;

(f) the minor panels of said front side wall member being folded around and adhesively secured to the respective minor and major panels of said rear side wall member;

(g) portions of said plastic film liner being adhesively secured to each other and being sandwiched between minor panels of respective side wall members.

2. A composite cup according to claim 1, wherein said plastic film liner is polyethylene terephthalate.

3. A composite cup according to claim 1, wherein portions of said plastic film liner are secured to each other by a liquid-tight hot melt adhesive.

4. A composite cup according to claim 1, wherein certain of said side wall members have openings in their major panels to afford visual access to the interior of the cup through said plastic film liner.

5. A collapsible, self-standing, liquid tight, partially transparent, disposable, drinking cup formed from a composite blank of plastic film and paperboard, comprising:

(a) a pair of paperboard side wall members interconnected to form a tubular structure open at its upper and lower ends;

(b) a plastic film liner adhesively secured to inner surfaces of and extending between said side wall members to form a bottom wall member for closing the lower end of said structure;

(c) said side wall members having central portions spaced from each other and having side portions joined to each other to form with said bottom wall member a liquid receiving cavity;

(d) each of said side wall members including:

(i) a pair of major panels having inboard side edges foldably joined to each other and having outboard side edges:

(ii) minor panels foldably joined to the outboard side edges of said major panels;

(e) the minor panels of one of said side wall members being disposed in face-to-face relationship with and attached to corresponding minor panels of the other side wall member to form first and second panel sets at opposite sides of said tubular structure, with portions of said plastic film liner being sandwiched therebetween and being secured to each other.

6. A composite cup according to claim 5, wherein said plastic film liner is polyethylene terephthalate.

7. A composite cup according to claim 5, wherein portions of said plastic film liner are secured to each other by a liquid-tight hot melt adhesive.

8. A composite cup according to claim 5, wherein certain of said side wall members have openings in their major panels to afford visual access to the interior of the cup through said plastic film liner.

9. A composite cup according to claim 5, wherein at least one of said panel sets is folded against and secured to a major panel of one of said side wall members.

10. A composite cup according to claim 5, wherein both of said panel sets are folded against and secured to respective major panels of one of said side wall members.

11. A composite cup according to claim 5, wherein one of said panel sets is folded against and secured to a major panel of one of said side wall members and the other of said panel sets is disposed to extend laterally outward from said tubular structure and function as a handle for said composite cup.

12. A composite cup according to claim 5, wherein both of said panel sets are disposed to extend laterally outward from said tubular structure and function as handles for said composite cup.

13. A composite blank of plastic film and foldable paperboard for use in forming a collapsible, self-standing, liquid tight, partially transparent, disposable, drinking cup, said blank being cut and scored to provide:

(a) a pair of generally similar, paperboard, side wall members each including:

(i) a pair of major panels having inboard side edges foldably joined to each other and having outboard side edges;

(ii) minor panel sections foldably joined to outboard side edges of said major panels;

(b) said side wall members being detachably joined to each other along a transverse weakened line of tear, in offset end-to-end relation, with the major and minor panels of each side wall member aligned with the major and minor panels of the other side wall member:

(c) a sheet of plastic film overlying portions of said side wall members and being adhesively secured to certain panels of said side wall members.

14. A composite blank according to claim 13, wherein said plastic film liner is polyethylene terephthalate.

15. A composite blank according to claim 13, wherein certain of said side wall members have openings in their major panels to afford visual access to the interior of the cup through said plastic film liner when said blank is erected into a cup.

* * * * *